US007604772B2

(12) United States Patent
Axenov et al.

(10) Patent No.: US 7,604,772 B2
(45) **Date of Patent: *Oct. 20, 2009**

(54) ALUMINUM-BASED MATERIAL AND A METHOD FOR MANUFACTURING PRODUCTS FROM ALUMINUM-BASED MATERIAL

(76) Inventors: Andrei Anatolyevich Axenov, Kv. 34, D. 26, oul. Novatorov, Moscow (RU); Nikolay Alexandrovich Belov, Kv. 42, D. 25, Sirenevy boul, Moscow (RU); Vadim Semenovich Zolotorevskij, Kv. 370, D. 86, Leninsky Prospect, Moscow (RU)

( * ) Notice: Subject to any disclaimer, the term of this patent is extended or adjusted under 35 U.S.C. 154(b) by 280 days.

This patent is subject to a terminal disclaimer.

(21) Appl. No.: 11/402,293

(22) Filed: Apr. 10, 2006

(65) Prior Publication Data

US 2007/0039668 A1 Feb. 22, 2007

Related U.S. Application Data

(63) Continuation-in-part of application No. 10/457,136, filed on Jun. 9, 2003, now Pat. No. 7,045,094, which is a continuation of application No. 09/601,635, filed on Dec. 12, 2000, now Pat. No. 6,585,932.

(51) Int. Cl.
*C22F 1/04* (2006.01)

(52) U.S. Cl. ..... 420/532; 148/549

(58) Field of Classification Search ..... 420/532; 148/549

See application file for complete search history.

(56) References Cited

U.S. PATENT DOCUMENTS 6,585,932 B1 * 7/2003 Axenov et al. ..... 420/532
7,045,094 B2 * 5/2006 Axenov et al. ..... 420/532

* cited by examiner

*Primary Examiner*—George Wyszomierski
*Assistant Examiner*—Weiping Zhu
(74) *Attorney, Agent, or Firm*—The Eclipse Group LLP

(57) ABSTRACT

An aluminum-based material and method of manufacturing products from the aluminum-based material formed by a solid solution of zinc, magnesium and copper in aluminum with dispersed phase particles of aluminum, zinc, magnesium and copper essentially evenly distributed in the solution and particles of nickel aluminide being essentially evenly distributed in the matrix of the aluminum-based material that contains particles, essentially evenly distributed in the matrix, of at least one of the aluminides group such as chromium aluminide and zirconium aluminide, with a total content of 0.1-0.5% of the volume with the maximum amount of nickel aluminide particles being 3 μm and the proportion between the maximum and minimum amount of nickel aluminide particles of no more than 2 and with the maximum amount of chromium aluminide and zirconium aluminide particles is 0.05 μm, resulting in the aluminum-based material having a microhardness of no less than 170 HV, a tensile strength of no less than 530 MPa and elongation of no less than 2%.

3 Claims, 1 Drawing Sheet

ALUMINUM-BASED MATERIAL AND A METHOD FOR MANUFACTURING PRODUCTS FROM ALUMINUM-BASED MATERIAL

CROSS REFERENCE TO RELATED APPLICATIONS

This application claims priority to and is a continuation-in-part of U.S. patent application Ser. No. 10/457,136, filed on Jun. 9, 2003, titled AN ALUMINUM-BASED MATERIAL AND A METHOD FOR MANUGACTURING PRODUCTS FROM ALUMINUM-BASED MATERIAL that issued as U.S. Pat. No. 7,045,094, which is a continuation of U.S. patent application Ser. No. 09/601,635, filed on Dec. 12, 2000, titled AN ALUMINUM-BASED MATERIAL AND A METHOD FOR MANUFACTURING PRODUCTS FROM ALUMINUM-BASED MATERIAL that issued as U.S. Pat. No. 6,585,932 and are incorporated by reference into this Application.

FIELD OF THE INVENTION

The innovation belongs to the area of metallurgy of aluminum-based materials and a method of manufacturing products from such materials that can be used for recreational equipment, in various vehicles and their parts, and as an additive material for welding articles produced from aluminum-based material.

RELATED ART

There are known aluminum-based materials that contain a matrix formed by a solid solution of certain elements, in particular, by a solid solution of copper in aluminum, and solidified particles of aluminide, including, according to (U.S. Pat. No. 5,300,157, cl. MKI(5) C22C 21/00, cl. NKI 148/437, 1994), nickel aluminides that are essentially uniformly distributed in the matrix. Such materials exhibiting a high degree of hardness and wear resistance are complex to produce and require laser technology of powder-coating materials in an inert gas atmosphere.

Also known are aluminum-based materials having a matrix formed by a solid solution of zinc, magnesium and copper in aluminum with the magnesium content being higher than the copper content and being lower than the zinc content, and containing solidified aluminides, such as particles of nickel aluminide (SU-AI N 1061495, cl. MKI(5) C 22 C 21/10, 1992), all these particles being essentially uniformly distributed in the matrix.

Such materials exhibit high strength properties with satisfactory ductility but they are also difficult to produce, because their production requires casting by granulation technique that provides the solidification of materials at a rate no less than 1000 K/s.

The material that seems closest to the claimed material is an aluminum-based material having a matrix formed by a solid solution of zinc, magnesium and copper in aluminum with dispersed particles of phases formed by aluminum, zinc, magnesium and copper essentially uniformly distributed in this solution. The material has a magnesium content that is higher than the copper content and lower than the zinc content. The material also contains solidified particles of nickel aluminides that constitute 3.5-11% of the total volume of the material and are essentially uniformly distributed in the matrix. (N. A. Belov et al., "The Effect of Nickel Aluminide and Magnesium Silicide on the Structure, Mechanical and Casting Properties of an Al—Zn—Mg—Cu Alloy," Izv. Ross. Akad Nauk, Metally, No. 1, 1992, pp. 146-151).

This material combines high strength and ductility with satisfactory technological properties providing the possibility of manufacture articles by shaped castings and low pressure. However, in some cases, the durability and casting properties of such a material proved to be insufficient.

Also known is the process of making articles from an aluminum-based material by casting them from a molten mixture of aluminum, zinc, magnesium, and nickel which includes heating, holding, quenching, and aging. (N. A. Belov, V. S. Zolotorevskii, E. E. Tagiev. "The Effect of Nickel Aluminide and Magnesium Silicide on the Structure, Mechanical and Casting Properties of an Al—Zn—Mg—Cu Alloy," Izv. Ross. Akad. Nauk, Metally, no. 1, 1992, pp. 146-151). However, this process does not allow one to obtain articles with required level and stability of mechanical properties.

SUMMARY

The main objective of the present invention is to develop an aluminum-based material exhibiting a high strength and ductility properties, namely, a tensile strength no less than 530 MPa and an elongation of no less than 2%, which provide, in combination with good technological properties, the possibility of producing items, including thin-walled articles, by means of shaped casting into metallic molds, for example under low pressure, or by liquid forging. Another objective of the invention is to develop a method for manufacturing aluminum-based articles, including thin-walled articles, having said strength and ductility properties.

In accordance with an embodiment of the present invention, an aluminum-based material having a matrix formed by a solid solution of zinc, magnesium and copper in aluminum with uniformly distributed dispersed particles of phases formed by aluminum, zinc, magnesium and copper with the magnesium content being higher than the copper content and being lower than the zinc content, and contains solidified particles of nickel aluminide are essentially uniformly distributed in the matrix and constitute 3.5-11% of the volume of the material. The material additionally contains particles of at least one of the aluminides group consisting of chromium aluminide and zirconium aluminide, with a total content of 0.1-0.5% of the material volume, which are essentially uniformly distributed in the matrix. The matrix has a microhardness of no less than HV 170; the size of nickel aluminide particles does not exceed 3 μm, and the maximum-to-minimum size ratio of no more than 2.

The particles of chromium aluminides and zirconium aluminides are no larger than 0.05 μm. In this case, the tensile strength will be no less than 530 MPa and the elongation will be no less than 2% because the particles of chromium aluminide and/or zirconium aluminide, in combination with other strengthening phases, provide an additional strengthening of the matrix, increasing its microhardness up to a value no less than 170 HV. This value is chosen with the aim to provide the prescribed strength of the material, while the content of aluminide particles is chosen from the following considerations. If the content of the particles is lower than the minimum value, the prescribed microhardness value of the matrix is not attained; if, however, the content of the particles exceeds the maximum value, the elongation decreases below the prescribed value. The limitation on the size of the particles of nickel aluminides is set to prevent cracking and the lowering of strength and ductility of the material.

The formulated task is solved also in such a way that in order to manufacture products from aluminum-based material with tensile strength no less than 530 MPa and elongation no less than 2% by means of casting from a molten mixture of aluminum, zinc, magnesium, copper and nickel. In the process, solidification of the material is followed by heat treatment of the material, including heating, holding, quenching, and aging. According to an embodiment of the innovation, at least one of the elements from a group that includes chromium and zirconium is introduced into the molten mixture. The solidification of the material is released at a rate of 2 to 90 K/s, and the heating of articles before quenching is accomplished in two steps. In the first step, the temperature is established at a level of 5-10 K lower than the temperature of nonequilibrium solidus of the material. In the second step, at a level that is higher than the nonequilibrium solidus temperature lower than the temperature of the equilibrium solidus of the material. Articles obtain, after aging, the material comprising (1) a matrix that has a microhardness no less than HV 170 and is formed by a solid solution of zinc, magnesium, and copper in aluminum and dispersed particles of phases formed by aluminum, zinc, magnesium, and copper uniformly distributed in the matrix, with a volume fraction of 3.5-11%, the maximum size no larger than 3 μm, and the maximum-to-minimum size ratio no higher than 2; and (3) particles of at least one of the aluminides selected from a group consisting of chromium aluminides and zirconium aluminides with a total volume fraction of 0.1 to 0.5% of the material volume, these particles being also uniformly distributed in the matrix.

The introduction of chromium and/or zirconium to the molten mixture of aluminum, zinc, magnesium, copper and nickel provides the formation in the material of an article of particles of chromium aluminide and/or zirconium aluminide, which increases the strength of the material. The rate of solidification indicated above makes it possible to fabricate articles by shaped casting, for example by low pressure or using liquid die forging. The temperatures prescribed for the regimes of heating and annealing before quenching enables one to obtain the structure of the material with a specified strength and ductility.

DETAILED DESCRIPTION

Figure 1:
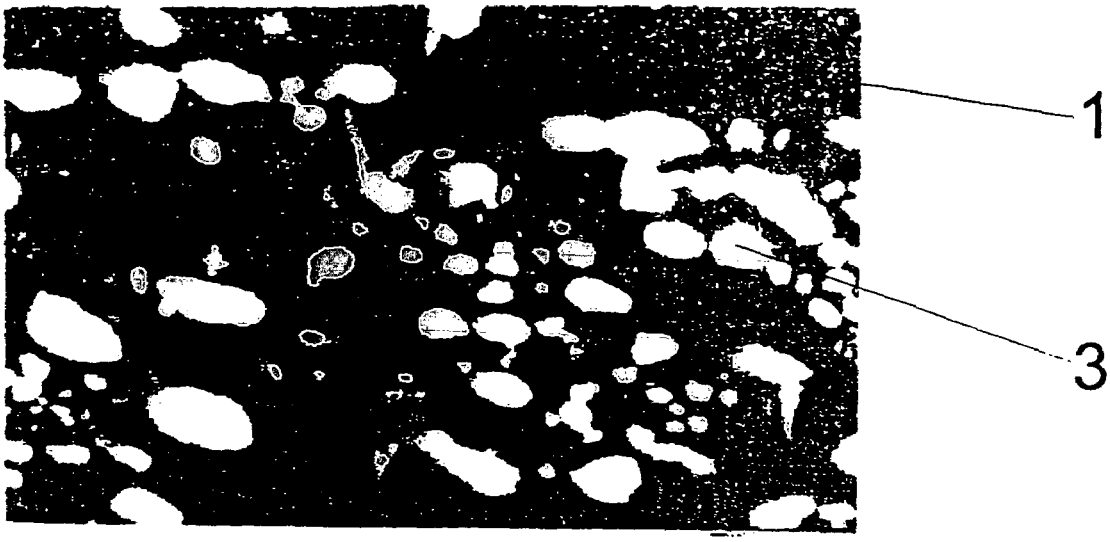
FIG. 1 is a microphotograph of the material of an embodiment of the present invention after heat treatment (×3000 times).
Figure 2:
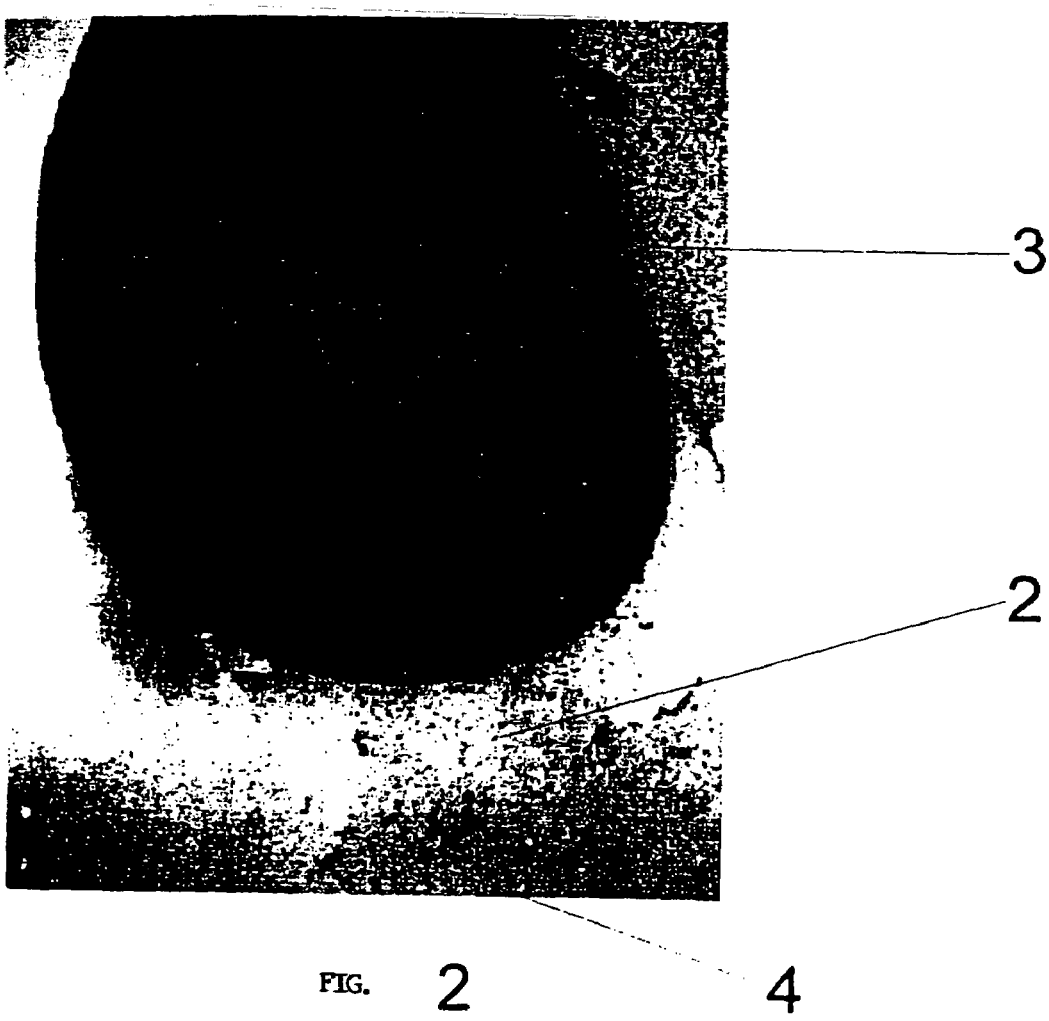
FIG. 2 is a microphotograph of the material of FIG. 1 after heat treatment (×40,000 times).

The material contains matrix 1 (FIG. 1), formed by a solid solution of zinc (Zn), magnesium (Mg), and copper (Cu) in aluminum (Al) with essentially uniformly distributed particles 2 (dark dots in FIG. 2) formed by Al, Zn, Mg, and Cu. Matrix 1 has the following composition by wt %: Zn-5-8% (preferably 6%), Mg-1.5-3% (preferably 2%), Cu-0.5-2% (preferably 1%), Al-remainder.

In all cases, the magnesium content is higher than the copper content and lower than the zinc content. Particles 3 (FIGS. 1 and 2) of solidified nickel aluminides constitute 3.5 to 11% of the material volume (preferably 7%) are essentially uniformly distributed in matrix 1. The maximum amount (not designated) of particle 3 does not exceed 3 μm with the proportion between the maximum and minimum amount (not designated) does not exceed 2. The matrix additionally contains essentially uniformly distributed particles 4 (block dots in FIG. 2) of aluminides selected from a group that includes chromium aluminide ($Al_xCr_y$) and zirconium aluminides ($Al_mZr_n$), with a maximum amount of 0.05 μm. In Table 1 are listed examples of implementation with the given content of chromium aluminides ($Al_xCr_y$) and zirconium aluminides ($Al_mZr_n$) (% volume), the size of which does not exceed 0.05 μm.

Table 1 gives examples of carrying out the present invention, showing the contents (in wt % of chromium aluminides ($Al_xCr_y$) and zirconium aluminides ($Al_mZr_n$), the microhardness determined by the Vickers method (HV), the tensile strength $\sigma_u$ (Mpa) of the material, and the elongation (δ %) (the properties of the material are indicated after thermal treatment).

TABLE 1

| Example no. | $Al_xCr_y$ (% vol.) | $Al_mZr_n$ (% vol.) | HV | $\sigma_B$, MPa | δ% |
|---|---|---|---|---|---|
| 1 | 0.1 | — | 170 | 530 | 3 |
| 2 | 0.3 | — | 173 | 535 | 2.8 |
| 3 | 0.5 | — | 175 | 540 | 2 |
| 4 | — | 0.1 | 172 | 540 | 3 |
| 5 | — | 0.3 | 180 | 548 | 3 |
| 6 | — | 0.5 | 181 | 545 | 2.5 |
| 7 | 0.1 | 0.1 | 176 | 543 | 2.5 |
| 8 | 0.2 | 0.2 | 180 | 545 | 2.5 |

In all the examples, the total volumn of $Al_xCr_y$ and $Al_mZr_n$ particles is equal to 0.1-0.5% of material volume, the microhardness of the matrix is not less than 170 HV, the tensile strength of the material is no less than 530 MPa and the relative elongation is not less than 2%.

Articles are made from this material in the following way. At least one of the elements of a group consisting of chromium and zirconium is introduced into the molten mixture of Al, Mg, Cu, and Ni. Articles are obtained from the molten mixture by shaped casting, for example liquid die forging, during which the solidification of the material occurs at a rate of 2 K/sec -90 K/sec. Then, the heat treatment of the article, including heating, holding, quenching, and subsequent aging is carried out. The hardening by quenching is made in parallel with heating in two steps: In the first step, the temperature is established at 5-10 K lower than the temperature of the nonequilibrium of the solidus or the material. While in the second step, the temperature is established at a level higher than the temperature of the nonequilibrium of the solidus and lower than the temperature of the stable solidus of the material. Articles are held at these two temperatures during the time interval, which is sufficient for obtaining, after aging, the material described above. The material has (1) a matrix having a hardness no less than HV 170 and formed by a solid solution of Zn, Mg, and Cu in Al with essentially uniformly distributed dispersed particles of phases formed by Al, Zn, Mg and Cu; (2) Particles of nickel aluminides essentially evenly distributed in the solution. Particles of nickel aluminide essentially uniformly distributed within the matrix and having a maximum size no larger than 3 μm, and a maximum-to-minimum size ratio no higher than 2 with a total volume of 3.5-11% of the material volume (depending on the nickel content in the molten mixture); and (3) particles of at least one of the aluminides, such as chromium aluminide and zirconium aluminide, with a total volume of 0.1 to 0.5% of the material volume (depending on the quantity of chromium and/or zirconium introduced in the molten mixture).

In the examples of the embodiments of the invention, the hot shortness index, which specifies the tendency of the material to cracking in the casting process, was determined by the so-called ring test (I.I. Novikov. *Hot Shortness of Non-ferrous Metals and Alloys*. Nauka, 1966). This characteristic corresponds to the minimum diameter of the rod that provides the formation of cracks in a ring-shaped chill casting. A larger hot shortness index indicates a higher fracture resistance and consequently, the better the casting properties of the material.

For the material corresponding to the examples of embodiments of the invention described above the hot shortness index falls within the range of 50-52 mm, which is better than existing high-strength aluminum-based casting materials, such as 201.0 grade aluminum alloy (according to US classification), for which the hot shortness index lies within the range of 46-48 mm and corresponds to the hot shortness indicator of welded Al—Mg alloys.

The above-described improved aluminum enables thin-walled castings to be formed and to join the casting by welding with other articles made from the same material produced by the same method or by welding the articles produced from other aluminum-based materials. The improved aluminum may also be used as an additive for welding Some other materials can be inserted into articles fabricated by the method described above directly in the process of casting. Some types of fabrication that is known and may be used with the aluminum-based materials as described above include extrusion processes, fluid forging, permanent mold (Chill Casting), Squeeze Casting, Semi-Solid Casting, Die Casting, Sheet Rolling Processes, and Plate Rolling Processes.

The present invention can be used in recreational equipment, such as: baseball bats, hockey sticks, field hockey sticks, golf club heads, tennis rackets, racquetball rackets, badminton rackets, squash rackets, ski boots, athletic wheelchairs, arrows, javelins, windsurfer frames, masts and other parts of yachts and sailboats, tent poles, ski components, downhill skis. It can also be used in various modes of transportation such as: automobiles, including frames, bumpers, auto-body parts, wheels, door parts and internal panels, railway and monorail cars, snow tractors, motorcycles, bicycles and mopeds, including handlebars, pedals, crankshafts, crankshaft levers, suspension brackets, seat posts, wheel rims, spokes, brake parts and gear shift mechanisms, as well as other modes of transportation and their body parts, screws, chassis parts, longerons, stringers, floor beams, loading platforms, instrument panel casings, fuel tanks and as filler metal in welding.

We claim:

1. An aluminum-based material, comprising:

a matrix formed by a solid solution of zinc, magnesium, and copper in aluminum with dispersed particles of phases composed of aluminum, zinc, magnesium, and copper and essentially uniformly distributed in said solid solution wherein said matrix comprises Zn 5-8%, Mg 1.5-3%, Cu 0.5-2%, balance AL, the magnesium content being higher than the copper content, said aluminum-based material containing particles of solidified nickel aluminides essentially uniformly distributed in said matrix and having a total volume of 3.5% to 11% of the aluminum-based material volume, wherein said aluminum-based material additionally comprises essentially uniformly distributed particles of at least one of the aluminides selected from a group consisting of chromium aluminides and zirconium aluminides and having a total volume equal to 0.1% to 0.5% of the aluminum-based material volume, said matrix having a microhardness no less than HV 170, said particles of solidified nickel aluminides having a maximum size no larger than 3 μm and a maximum-to-minimum ratio no higher than 2; and the matrix formed by the solid solution shaped by one of the processes selected from a group of process consisting of extrusion, fluid forging, permanent mold, Squeeze Casting, Semi-Solid Casting, Die Casting, Sheet Rolling, or Plate Rolling.

2. The aluminum-based material according to claim 1, wherein said chromium aluminide particles and said zirconium aluminide particles have a maximum size no larger than 0.05 μm.

3. The aluminum-based material according to claim 1, wherein said aluminum-based material has a tensile strength of at least 530 Mpa and an elongation of at least 2%.

* * * * *